United States Patent [19]

Rose et al.

[11] Patent Number: 4,506,124

[45] Date of Patent: Mar. 19, 1985

[54] PUSH-PUSH SWITCH

[75] Inventors: William H. Rose, Harrisburg; David W. Rupnik, Mechanicsburg; David T. Shaffer, Harrisburg, all of Pa.

[73] Assignee: AMP Incorporated, Harrisburg, Pa.

[21] Appl. No.: 543,667

[22] Filed: Oct. 19, 1983

[51] Int. Cl.[3] ..... H01H 13/56

[52] U.S. Cl. ..... 200/153 J; 200/153 LB; 74/129

[58] Field of Search ..... 200/153 J, 153 LB, 156, 200/159 A; 74/88, 129

[56] References Cited

U.S. PATENT DOCUMENTS

| | | | |
|---|---|---|---|
| 2,965,737 | 12/1960 | Lewis et al. | 200/156 |
| 3,226,991 | 1/1966 | Hartsock | 200/156 |
| 3,646,297 | 2/1972 | Anthony | 200/153 LB |
| 3,694,603 | 9/1972 | Congelliere et al. | 200/153 J |
| 3,869,928 | 3/1975 | Ishii et al. | 74/88 |
| 4,025,738 | 5/1977 | Erwin et al. | 200/153 LB |
| 4,129,764 | 12/1978 | Ohkita et al. | 200/153 J |

FOREIGN PATENT DOCUMENTS

| | | | |
|---|---|---|---|
| 515225 | 1/1931 | Fed. Rep. of Germany | 200/156 |

*Primary Examiner*—John W. Shepperd
*Attorney, Agent, or Firm*—Adrian J. LaRue

[57] ABSTRACT

A push-push switch comprises a dielectric housing in which electrical contact members are secured; contact sections of the contact members are in normal electrical engagement and terminal sections of the contact members are to be electrically connected to conductive members. An actuating member is mounted in the housing for reciprocal and rotational movement therein; a spring biases the actuating member to a normal rest position. Cam members on the actuating member engage the contact members in one position to disengage them and are out of engagement with the contact members in another position causing them to be normally engaged. First and second rows of cam segments are on the actuating member; the cam segments in each of the rows are spaced from one another and the cam segments in the first row are offset with respect to the cam segments in the second row so that cam surfaces of the cam segments of the first row face the cam segments in the second row and cam surfaces of the cam segments of the second row face the cam segments in the first row. Projections extend outwardly from the housing and are normally positioned between adjacent cam segments in the first row whereby, upon movement of the actuating-member from its normal rest position against the spring, the projections engage respective cam surfaces of the cam segments of the second row causing the actuating member to rotate so that the projections are in alignment with respective cam surfaces of the cam segments of the first row; and, upon movement of the actuating member back to the normal rest position, the projections engage the respective cam surfaces of the cam segments of the first row causing the actuating member to rotate further so that the projections are disposed between adjacent cam segments of the first row and the cam members move into engagement with the contact members to disengage the contact sections or move out of engagement with the contact members so that the contact sections are engaged.

13 Claims, 7 Drawing Figures

PUSH-PUSH SWITCH

FIELD OF THE INVENTION

This invention relates to electrical switches and more particularly to electrical switches of the push-push type.

BACKGROUND OF THE INVENTION

Push-Push switches of known construction use a movable contact member as part of the actuating mechanism to bridge the stationary contact members and a spring as part of the actuating mechanism maintains the movable contact member in electrical engagement with the stationary contact members. This results in an additional part and cannot provide single-pole double-throw operation. The actuator is loosely mounted in the switch housing causing it to rattle and an undesirable loud clicking occurs when the switch is operated.

SUMMARY OF THE INVENTION

According to the present invention a push-push switch comprises a dielectric housing in which electrical contact members are secured; contact sections of the contact members are in normal electrical engagement and terminal sections of the contact members are to be electrically connected to conductive members. An actuating member is mounted in the housing for reciprocal and rotational movement therein; a spring biases the actuating member to a normal rest position. Cam members on the actuating member engage the contact members in one position to disengage them and are out of engagement with the contact members in another position causing them to be normally engaged. First and second rows of cam segments are on the actuating member; the cam segments in each of the rows are spaced from one another and the cam segments in the first row are offset with respect to the cam segments in the second row so that cam surfaces of the cam segments of the first row face the cam segments in the second row and cam surfaces of the cam segments of the second row face the cam segments in the first row. Projections extend outwardly from the housing and are normally positioned between adjacent cam segments in the first row whereby, upon movement of the actuating-member from its normal rest position against the spring, the projections engage respective cam surfaces of the cam segments of the second row causing the actuating member to rotate so that the projections are in alignment with respective cam surfaces of the cam segments of the first row; and, upon movement of the actuating member back to the normal rest position, the projections engage the respective cam surfaces of the cam segments of the first row causing the actuating member to rotate further so that the projections are disposed between adjacent cam segments of the first row and the cam members move into engagement with the contact members to disengage the contact sections or move out of engagement with the contact members so that the contact sections are engaged.

DETAILED DESCRIPTION OF THE INVENTION

Figure 1:
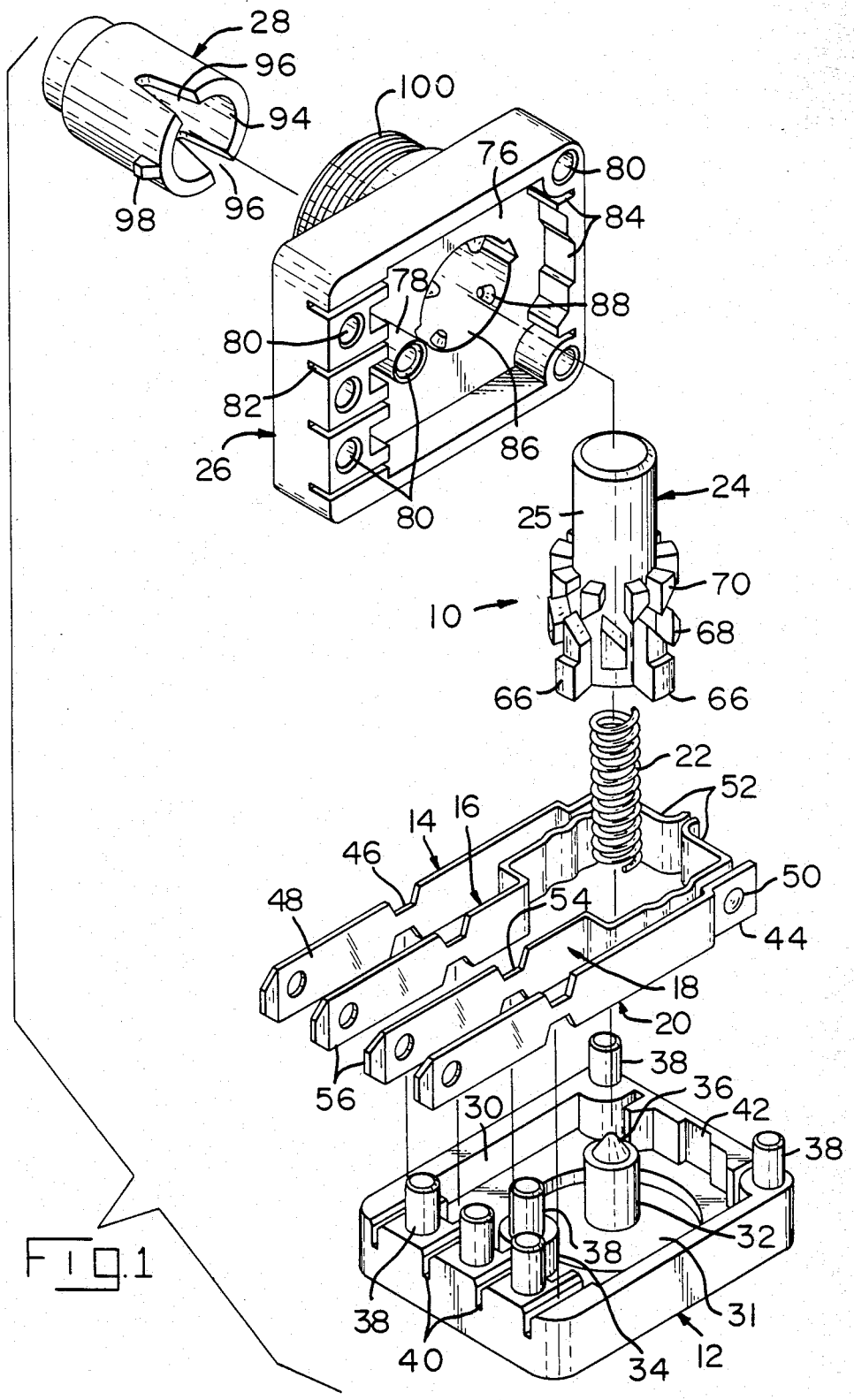
FIG. 1 is a perspective and exploded view showing the parts of the push-push switch.

As shown in the drawings, a push-push switch 10 includes a bottom housing member 12, electrical contact members 14, 16, 18, and 20, a coil spring 22, a contact-actuating member 24, an upper housing member 26 and actuator 28. Bottom housing member 12, contact-actuating member 24, upper housing member 26 and actuator 28 are molded from a suitable dielectric material, whereas contact members 14, 16, 18 and 20 are stamped and formed from a suitable metal having desirable electrical and spring characteristics.

Bottom housing member 12 has a cavity 30 and posts 32 and 34 extend outwardly from a bottom inner surface of housing member 12. A recess 31 is located in the inner surface coaxial with post 32. Post 32 has a conical projection 36 at a top surface thereof while post 34 has a circular projection 38 extending outwardly from the top surface thereof. Circular projections 38 also extend outwardly from a bottom wall of housing member 12 and the junctions of sidewalls and the top wall of housing member 12. Profiled slots 40 are located in the bottom wall of housing member 12 and are in communication with cavity 30. Recesses 42 are located in the inner surface of the top wall of housing member 12.

Contact members 14 and 20 have a contact section 44, a mounting section 46, and a terminal section 48. Contact section 44 is disposed in a respective recess 42 while mounting section 46 is positioned in a respective slot 40 so that contact section 44 operates with cantilever action with contact sections 44 being preloaded against inner surfaces of recesses 42. A radiussed contact 50 is located in contact section 44.

Figure 4:
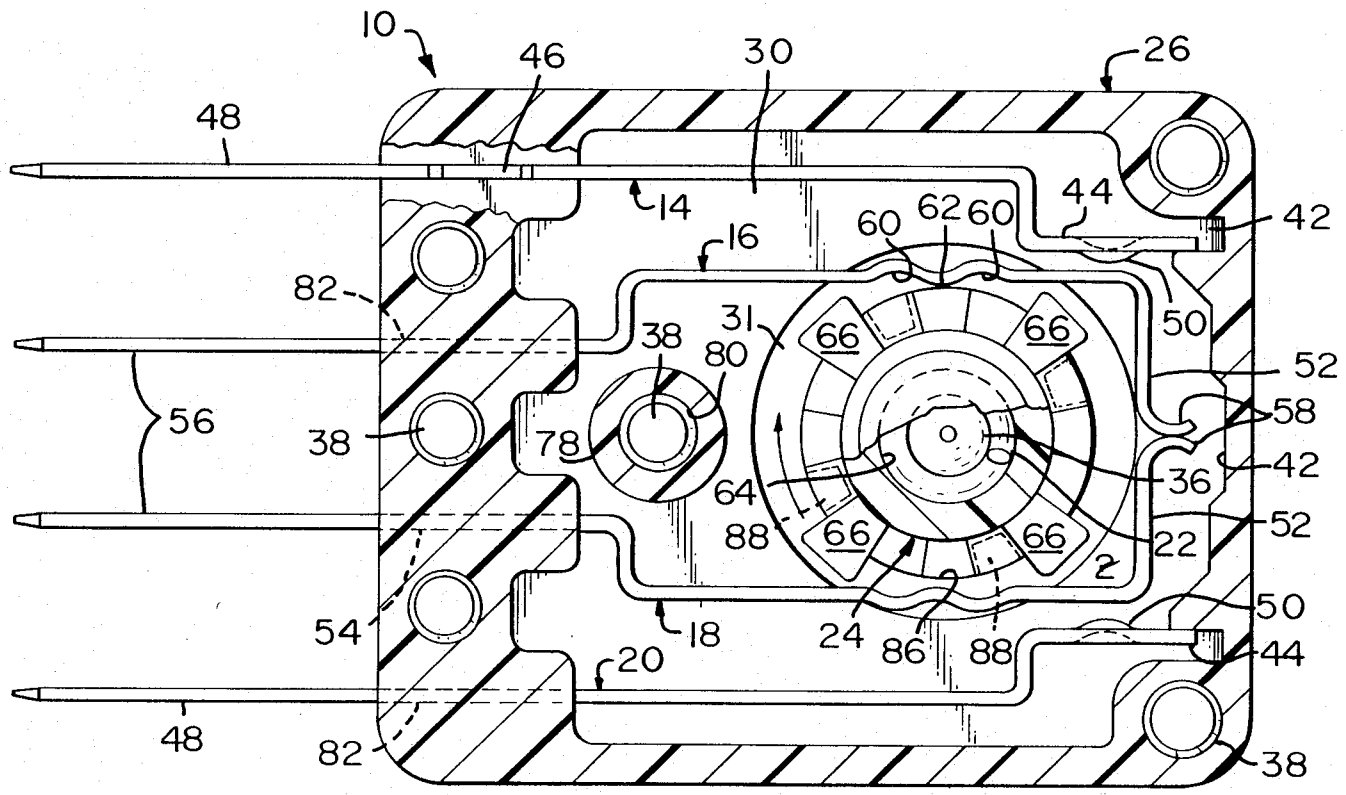
FIG. 4 is a cross-sectional view taken along line 4—4 of FIG. 3 showing the contact members normally engaged.

Contact members 16 and 18 have a U-shaped contact section 52, a mounting section 54 and a terminal section 56. Mounting sections 54 are positioned in respective slots 40 so that contact sections 52 extend along posts 32 and 34 and they operate as cantilevers with radiussed free ends in the form of contacts 58 that are in normal engagement as shown in FIG. 4. The areas of contact sections 52 in alignment with post 32 have concave surfaces 60 on each side of a convex surface 62 defining cam-engaging areas of sinusoidal configuration.

Figure 7:
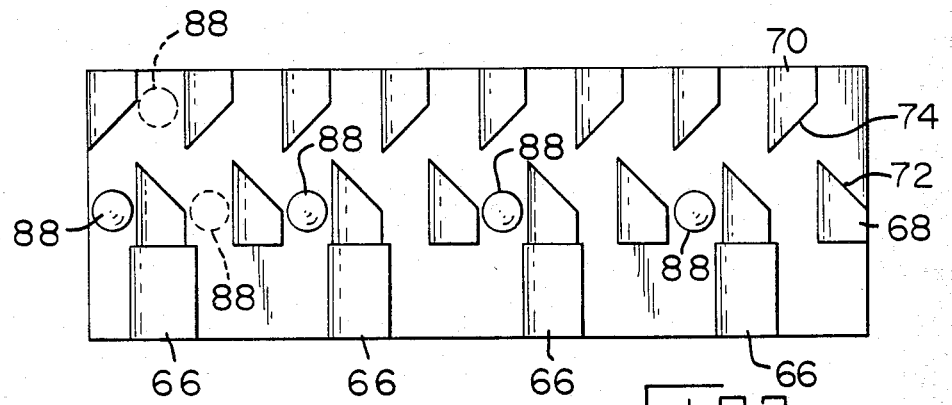
FIG. 7 is a layout of the cam members and cam segments of the operating member.

Contact-actuating member 24 has a bore 64 in which coil spring 22 is disposed and is reciprocally and rotationally mounted on post 32 with coil spring 22 engaging conical projection 36. Cam members 66 are disposed at 90-degree intervals at the bottom of member 24 and a first row of cam segments 68 is located on member 24 which is spaced from a second row of cam segments 70. As shown in FIG. 7, cam segments 68 are offset with respect to cam segments 70 so that cam surfaces 72 of cam segments 68 face upwardly while cam surfaces 74 of cam segments 70 face downwardly.

Figure 3:
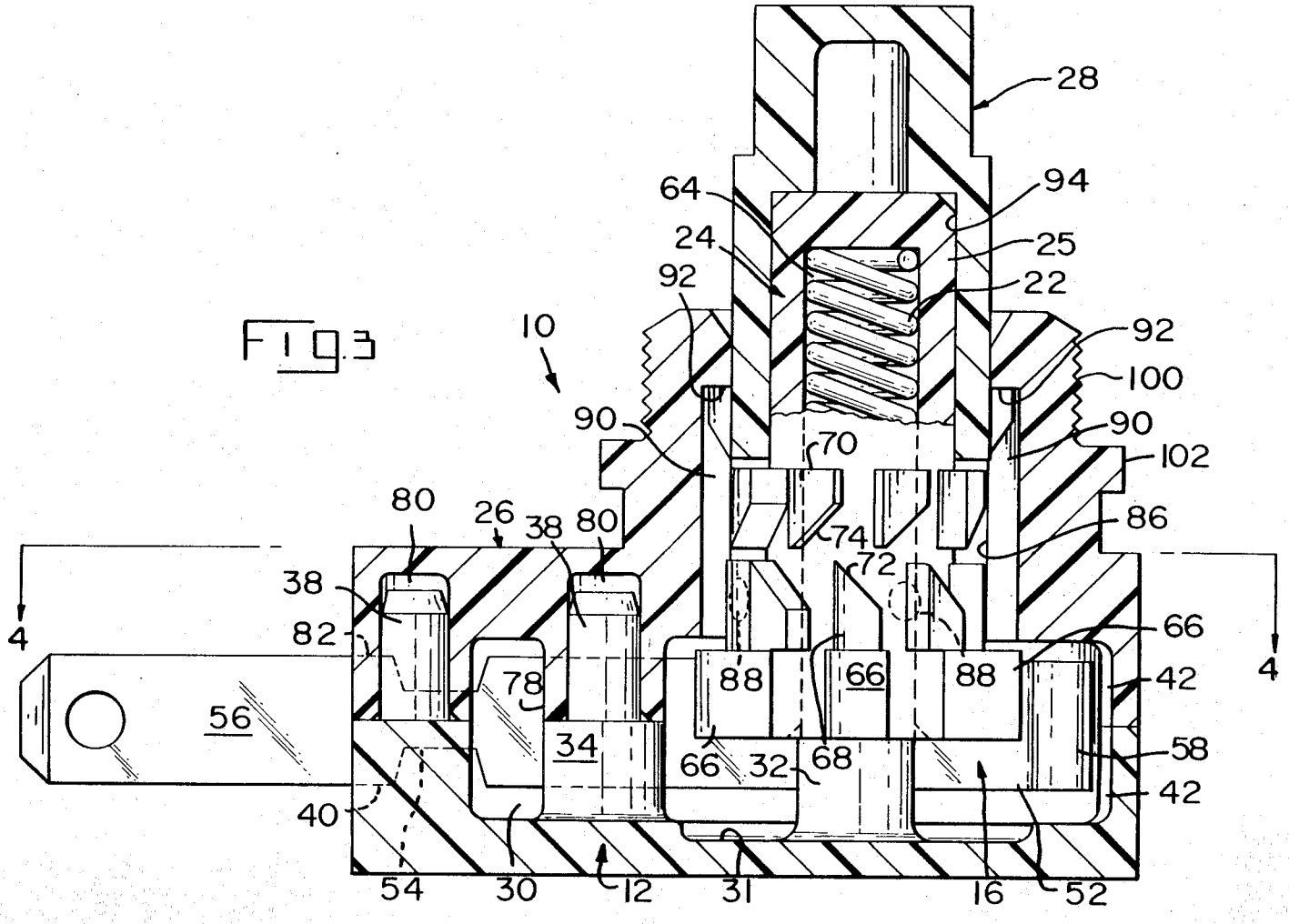
FIG. 3 is a cross-sectional view taken along line 3—3 of FIG. 2.
Figure 5:
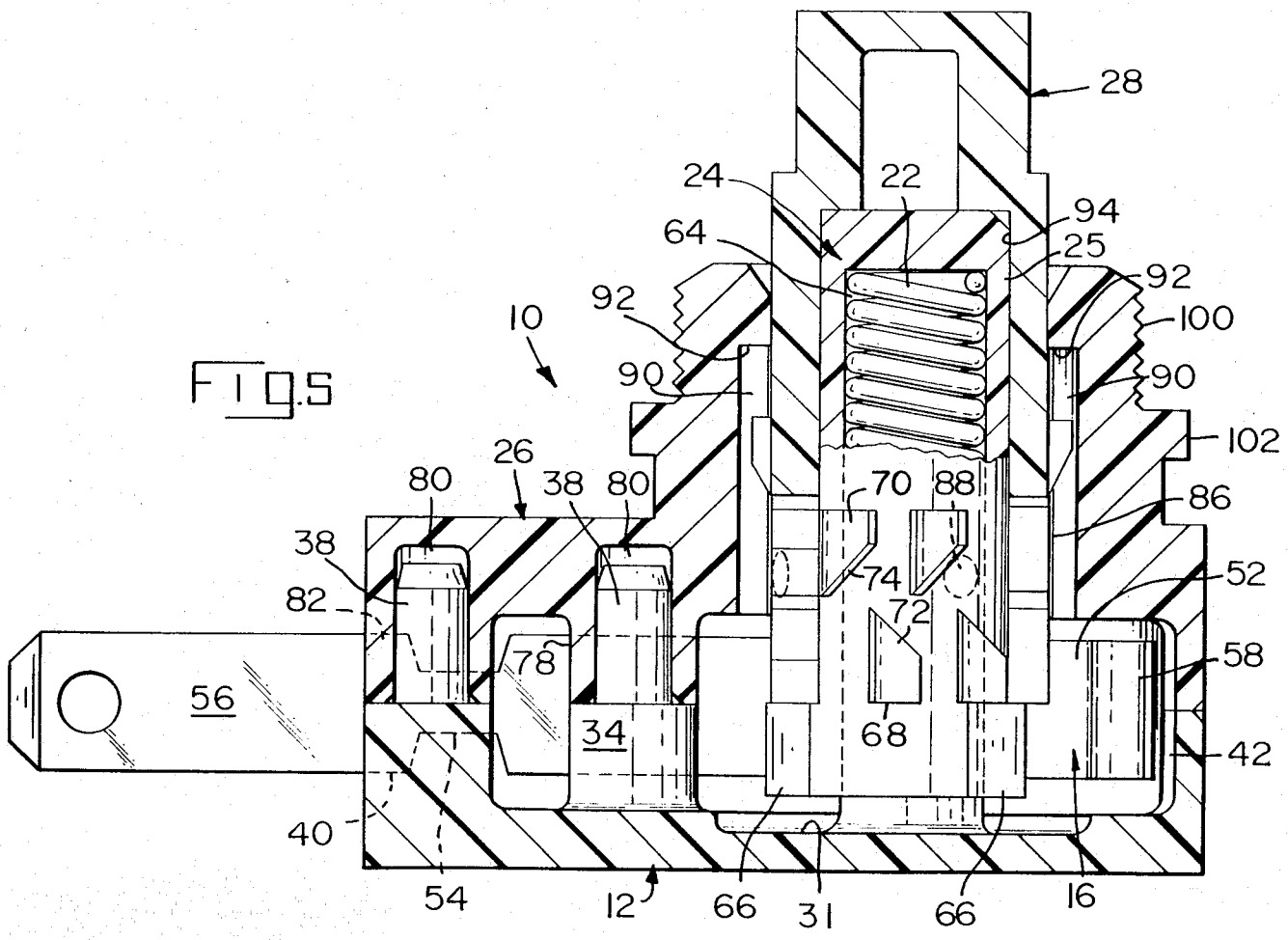
FIGS. 5 and 6 are views similar to FIGS. 3 and 4 showing the contact members disengaged.

Upper housing member 26 has a cavity 76 and a post 78 disposed opposite post 34. Holes 80 are located in the outer surface of the walls of housing member 26 and in post 78 which are in alignment with respective projections 38 so that projections 38 are interference fitted within holes 80 to align housing members 12 and 26 to maintain them in engagement when they are mated together. Profiled slots 82 engage mounting sections 46 and 54 of contact members 14, 16, 18 and 20 to secure them in position in the housing members for cantilever action. Recesses 84 are located on the inside surface of an upper wall of housing member 26 which are in communication with respective recesses 42 of housing member 12. Bore 86 extends through housing member 26 and has projections 88 extending outwardly from the wall of bore 86 at 90-degree intervals and they have a frustrum of a cone configuration. Diametrical slots 90 are located in the wall of bore 86 and they terminate at stop surfaces 92 as shown in FIGS. 3 and 5. Actuating member 24 is disposed in bore 86 with projections 88 disposed between adjacent cam segments 68 with cam members 66 out of engagement with contact sections 52 of contact members 16 and 18 as shown in FIG. 4.

Actuator 28 has a bore 94 in which an upper part 25 of actuating member 24 is disposed. Triangular-shaped spaces 96 are located in actuator 28 which separate the bottom part of actuator 28 into arcuate-shaped legs having projections 98 on external surfaces thereof. Spaces 96 enable the arcuate-shaped legs to flex inwardly to insert actuator 28 within bore 86 until projections 98 are positioned in slots 90 beyond stop surfaces 92 to enable actuator 28 to move reciprocally within bore 86. Threads 100 are located on housing member 26 to receive a threaded nut thereon and shoulder 102 is provided so that switch 10 can be mounted in an opening of a panel member.

Figure 2:
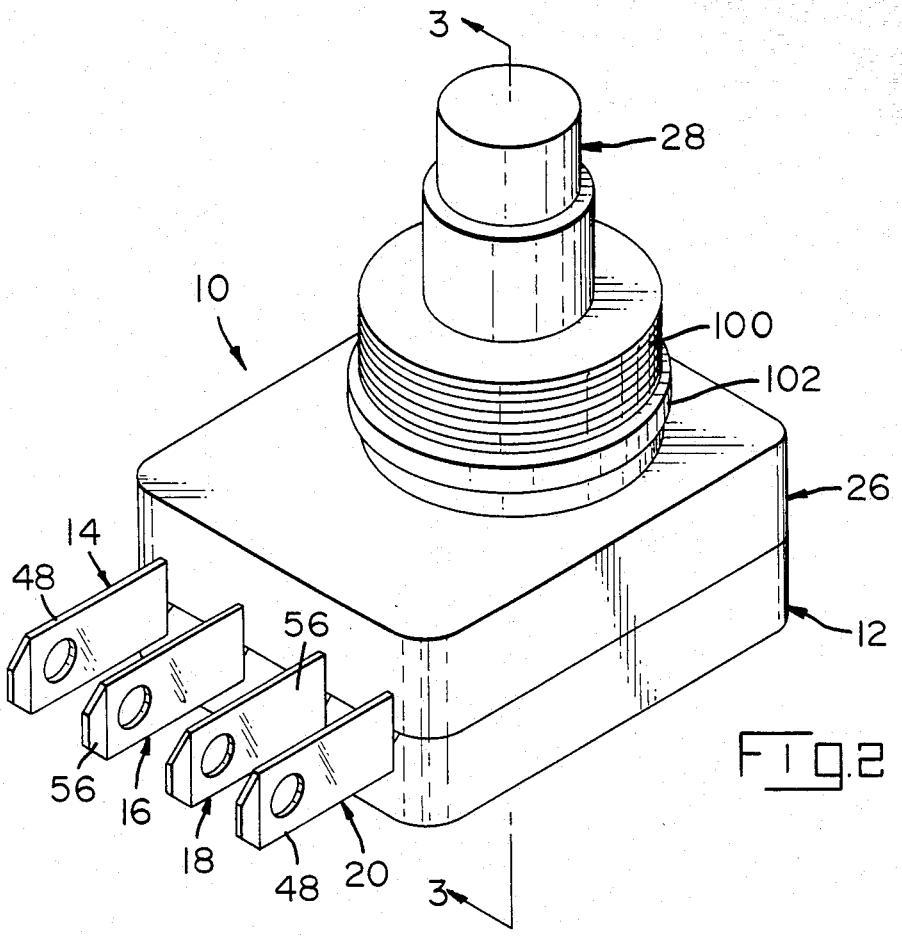
FIG. 2 is a perspective view of the switch of FIG. 1 in an assembled condition.
Figure 6:
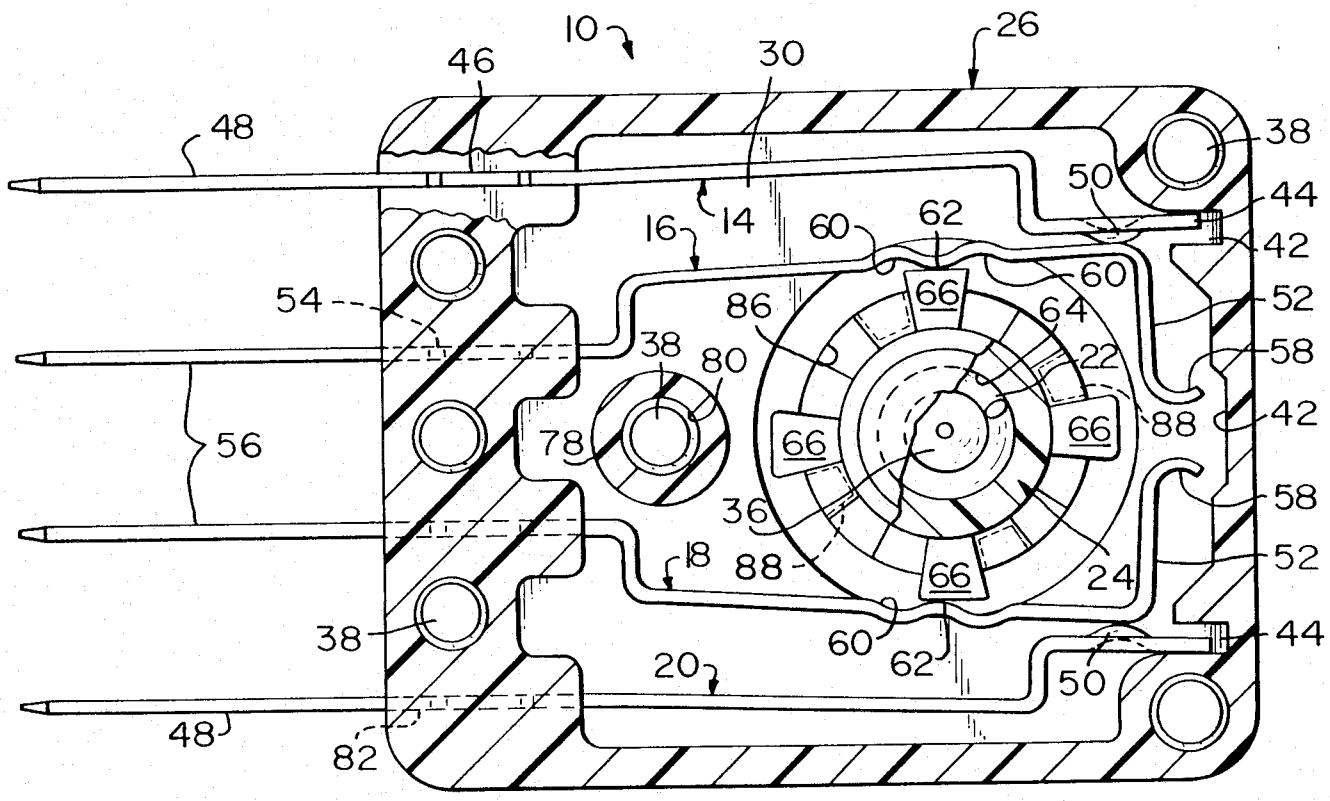

With switch 10 in its fully assembled condition as shown in FIG. 2, with cam members 66 of actuating member 24 in position as shown in FIG. 4 and with radiussed free ends 58 of contact sections 52 of contact member 16 and 18 in engagement, switch 10 can be operated to its actuated position as shown in FIG. 6 in accordance with the following operation. When an inwardly-directed force is applied to actuator 28, contact actuating member 24 is also moved inwardly compressing coil spring 22. Projections 88 engage cam surface 74 of cam segments 70 with which they are in alignment thereby causing actuating member 24 to partly rotate as cam surfaces 74 move along projections 88. In this position, cam members 66 are disposed in respective outer and inner concave surfaces 60 of contact sections 52 of contact members 16 and 18 which prevents actuating member 24 from reversing its operation and also causes projections 88 to be in alignment with adjacent cam surfaces 72 of cam segments 68 so that upon removal of the inwardly-directed force, spring 22 moves actuating member 24 and actuator 28 back to their normal rest positions and in so doing cam surfaces 72 move along projections 88 causing actuating member 24 to rotate further so that cam members 66 are disposed in engagement with convex surfaces 62 of contact sections 52 of contact members 16 and 18 as shown in FIG. 6 causing radiussed free ends 58 to be disengaged, contact sections 52 to electrically engage respective radiussed contacts 50 of contact members 14 and 20 and projections 88 are disposed between adjacent cam segments 68. Thus, a single-pole double-throw operation takes place. Repeating the above operation causes cam members 66 in engagement with convex surfaces 62 to move into respective inner and outer concave surfaces 60 whereafter cam members 66 move completely free of contact sections 52 enabling radiussed free ends 58 to re-engage and be disengaged from radiussed contacts 50 of contact members 14 and 20 as shown in FIG. 4.

One of contact members 14 or 20 can be eliminated so that switch 10 can then operate as a single-pole single-throw switch or, if desired, both contact members 14 and 20 can be eliminated resulting in switch 10 using contact members 16 and 18 to be in an on or off position relative to the position of cam members 66. Also, contact members 14, 16, 18 and 20 can be in the form of valve-operating members for opening and closing valves in a fluid system.

Actuator 28 operates reciprocally, whereas actuating member 24 operates reciprocally and rotationally when switch 10 is operated.

We claim:

1. A push-push switch, comprising:

a dielectric housing having electrical contact members secured therein, contact sections of the contact members are in normal electrical engagement and terminal sections of the contact members are electrically connectable with conductive members;

an actuating member mounted in the housing for reciprocal and rotational movement therein;

a spring biases the actuating member to a normal rest position;

cam members on the actuating member engage the contact members in one position to disengage them and are out of engagement with the contact members in another position causing them to be normally engaged whereby the cam members during the reciprocal and rotational movement of the actuating member always remain in operative alignment with the contact members;

first and second rows of cam segments on the actuating member, the cam segments in each of the rows are spaced from one another and the cam segments in the first row are offset with respect to the cam segments in the second row so that cam surfaces of the cam segments of the first row face the cam segments of the second row and cam surfaces of the cam segments of the second row face cam segments of the first row; and projections extend outwardly from the housing and are normally positioned between adjacent cam segments in the first row whereby upon movement of the actuating member from its normal rest position against the spring, the projections engage respective cam surfaces of the cam segments of the second row causing the actuating member to rotate so that the projections are in alignment with respective cam surfaces of the cam segments of the first row, and, upon movement of the actuating member back to normal rest position, the projections engage the respective cam surfaces of the cam segments of the first row causing the actuating member to rotate further so that the projections are disposed between adjacent cam segments of the first row and the cam members move into engagement with the contact members to disengage the contact sections or move out of engagement with the contact members so that the contact sections are engaged.

2. A push-push switch as set forth in claim 1, wherein an actuator is mounted in the housing and is reciprocally mounted therein, said actuating member has an upper part disposed in said actuator.

3. A push-push switch as set forth in claim 1 wherein said actuating member is reciprocally and rotationally mounted on a post in said housing and said spring is disposed between said actuating member and said post.

4. A push-push switch as set forth in claim 1, wherein said contact sections have sinusoidal areas for engagement by said cam members.

5. A push-push switch as set forth in claim 1, wherein at least one other contact member is secured in said housing which has a contact section disposed adjacent to but spaced from one of the contact sections of the normally-engaged contact members and is electrically engaged by the one of the contact sections when they are disengaged.

6. A push-push switch as set forth in claim 1, wherein other contact members are secured in said housing which have contact sections disposed adjacent to but spaced from respective contact sections of the normally-engaged contact members and are electrically engaged by this respective contact sections of the normally-engaged contact members when they are disengaged.

7. An electrical switch of the type comprising a dielectric housing in which electrical contact members are secured, the electrical contact members having contact sections for electrical engagement with each other, and a spring-biased actuating member for engagement with the contact sections, the improvement comprising:

cam members on the actuating member for engagement or disengagement with the contact sections during movement of said actuating member so that said cam members always remain in operative alignment with the contact sections;

first and second rows of cam segments on the actuating member, the first row of cam segments having cam surfaces facing the cam segments of the second row and the second row of cam segments having cam surfaces facing the cam segments of the first row;

projections on the housing that are normally disposed between adjacent cam segments of the first row, whereby upon movement of the actuating member from a normal position of rest, the projections engage respective cam surfaces of the second row of cam segments causing the actuating member to rotate so that the projections are in alignment with respective cam surfaces of the first row of cam segments and the cam members are in engagement with or out of engagement with the contact sections, and, upon movement of the actuating member back to its position of rest, the projections engage respective cam surfaces of the cam segments of the first row causing the actuating member to rotate further so that the projections are disposed between adjacent cam segments of the first row and the cam members move into engagement or out of engagement with the contact sections so that the contact sections are out of or in electrical engagement.

8. An electrical switch as set forth in claim 7, wherein another contact member is secured in the housing and includes a contact section disposed adjacent one of the contact sections of the contact members which is electrically engaged with the one of the contact sections when they are disengaged.

9. An electrical switch as set forth in claim 7, wherein the contact sections have sinusoidal areas engageable by the cam members.

10. An electrical switch as set forth in claim 7, wherein an actuator is reciprocally mounted in the housing and has a part of the actuating member disposed therein.

11. An indexing device comprising:

a housing member in which operating members are mounted;

an actuating member mounted in said housing member for reciprocal and rotational movement therein;

spring means biasing the actuating member to a normal rest position;

cam-operating means on said actuating member for engaging the operating members in one position and in another position the cam-operating means are out of engagement with the operating members whereby the cam-operating means during the reciprocal and rotational movement of said actuating member always remains in operating alignment with the operating members;

first and second rows of spaced cam segments on the actuating member, the first row of cam segments having cam surfaces facing the cam segments of the second row and the second row of cam segments having cam surfaces facing the cam segments of the first row;

projection means on the housing member disposed between adjacent cam segments of the first row whereby upon movement of the actuating member from the normal rest position against the bias of said spring means, the projection means engage respective cam surfaces of the second row of cam segments causing the actuating member to rotate so that the projection means are in alignment with respective cam surfaces on the first row of cam segments and the cam-operating means are in engagement with or out of engagement with the operating members, and upon movement of the actuating member back to its rest position under the influence of said spring means, the projection means engage respective cam surfaces of the cam segments of the first row causing the actuating member to rotate further so that the projection means are disposed between adjacent cam segments of the first row and the cam-operating means move into or out of engagement with the operating members.

12. An indexing device as set forth in claim 11, wherein said actuating member is reciprocally and rotationally mounted on a post in said housing member and said spring means is disposed between said actuating member and said post.

13. An indexing device as set forth in claim 11, wherein an actuator is reciprocally mounted in the housing member and said actuating member has an upper section disposed in said actuator for movement with said actuator and for rotational movement relative to said actuator.

* * * * *